US008640769B2

(12) United States Patent
Smith et al.

(10) Patent No.: US 8,640,769 B2
(45) Date of Patent: Feb. 4, 2014

(54) MULTIPLE CONTROL LINE ASSEMBLY FOR DOWNHOLE EQUIPMENT

(75) Inventors: Roddie R. Smith, Aberdeen (GB); Ronald D. Williams, Houston, TX (US); Robert Wojciechowski, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 34 days.

(21) Appl. No.: 13/226,810

(22) Filed: Sep. 7, 2011

(65) Prior Publication Data

US 2013/0056222 A1 Mar. 7, 2013

(51) Int. Cl.
*E21B 17/02* (2006.01)

(52) U.S. Cl.
USPC ..... 166/242.2; 166/242.6; 166/243

(58) Field of Classification Search
USPC ..... 166/378, 385, 242.2, 242.6, 243
See application file for complete search history.

(56) References Cited

U.S. PATENT DOCUMENTS

| | | | |
|---|---|---|---|
| 15,376 | A | 7/1856 | Humphrey |
| 3,598,238 | A | 8/1971 | Collins, Jr. |
| 4,065,094 | A | 12/1977 | Adams |
| 4,143,712 | A | 3/1979 | James et al. |
| 4,399,870 | A | 8/1983 | Baugh et al. |
| 4,460,040 | A | 7/1984 | Bowyer |
| 4,597,445 | A | 7/1986 | Knox |
| 4,621,695 | A | 11/1986 | Pringle |
| 4,624,315 | A | 11/1986 | Dickson et al. |
| 4,667,736 | A | 5/1987 | Rumbaugh et al. |
| 4,791,991 | A | 12/1988 | Morris et al. |
| 4,834,183 | A | 5/1989 | Vinzant et al. |
| 4,838,355 | A | 6/1989 | Leismer et al. |
| 4,945,993 | A | 8/1990 | Dickson et al. |
| 4,951,753 | A | 8/1990 | Eriksen |
| 4,986,357 | A | 1/1991 | Pringle |

(Continued)

FOREIGN PATENT DOCUMENTS

| | | |
|---|---|---|
| EP | 1006259 | 6/2000 |
| EP | 1241322 | 9/2002 |

(Continued)

OTHER PUBLICATIONS

Copending U.S. Appl. No. 12/890,056, entitled "Fail Safe Regulator for Deep-Set Safety Valve Having Dual Control Lines" by Roddie R. Smith and Donnie R. Clapp, filed Sep. 24, 2010.

(Continued)

*Primary Examiner* — David Bagnell
*Assistant Examiner* — Blake Michener
(74) *Attorney, Agent, or Firm* — Wong, Cabello, Lutsch, Rutherford & Brucculeri LLP

(57) ABSTRACT

Concentric control lines have an outer line disposed about one or more inner lines. Encapsulated together, the lines only require one penetration through the wellhead to extend downhole. At the wellhead, the lines communicate with an operating system, which can provide hydraulics, electric power, signals, or the like for downhole components. Beyond the wellhead, the concentric lines extend along the tubing to a manifold. The outer line sealably terminates at the manifold's inlet, while the inner conduit passes out an outlet with a sealed fitting to connect to a downhole component. A downhole line couples to an outlet of the manifold and communicates internally with the outer conduit terminated at the manifold's inlet. This downhole line can then extend to the same downhole component or some different component.

18 Claims, 5 Drawing Sheets

(56) References Cited

U.S. PATENT DOCUMENTS

| | | | | |
|---|---|---|---|---|
| 5,058,682 | A | 10/1991 | Pringle | |
| 5,125,457 | A | 6/1992 | Meaders | |
| 5,145,005 | A | 9/1992 | Dollison | |
| 5,167,284 | A | 12/1992 | Leismer | |
| 5,199,494 | A | 4/1993 | Williamson, Jr. | |
| 5,249,630 | A | 10/1993 | Meaders et al. | |
| 5,259,457 | A | 11/1993 | Williamson, Jr. | |
| 5,293,943 | A | 3/1994 | Williamson, Jr. | |
| 5,310,004 | A | 5/1994 | Leismer | |
| 5,343,955 | A | 9/1994 | Williams | |
| 5,358,053 | A | 10/1994 | Akkerman | |
| 5,415,237 | A | 5/1995 | Strattan | |
| 5,564,501 | A | 10/1996 | Strattan et al. | |
| 5,564,502 | A | 10/1996 | Crow et al. | |
| 5,682,921 | A | 11/1997 | Rawson et al. | |
| 5,799,949 | A | 9/1998 | Beall et al. | |
| 5,823,265 | A | 10/1998 | Crow et al. | |
| 5,918,858 | A | 7/1999 | Rawson et al. | |
| 5,947,206 | A | 9/1999 | McCalvin et al. | |
| 6,003,605 | A | 12/1999 | Dickson et al. | |
| 6,056,055 | A | 5/2000 | Falconer et al. | |
| 6,109,351 | A | 8/2000 | Beall | |
| 6,148,843 | A | 11/2000 | Pringle | |
| 6,173,785 | B1 | 1/2001 | Adams et al. | |
| 6,237,693 | B1 | 5/2001 | Deaton | |
| 6,260,850 | B1 | 7/2001 | Beall et al. | |
| 6,263,910 | B1 | 7/2001 | Davis et al. | |
| 6,283,477 | B1 | 9/2001 | Beall | |
| 6,296,061 | B1 | 10/2001 | Leisner | |
| 6,302,210 | B1 | 10/2001 | Crow et al. | |
| 6,328,062 | B1 | 12/2001 | Williams et al. | |
| 6,378,610 | B2 | 4/2002 | Rayssiguier et al. | |
| 6,491,106 | B1 | 12/2002 | Simonds | |
| 6,502,640 | B2 | 1/2003 | Rayssiguier et al. | |
| 6,505,684 | B2 | 1/2003 | Rayssiguier et al. | |
| 6,513,594 | B1 | 2/2003 | McCalvin et al. | |
| 6,523,613 | B2 | 2/2003 | Rayssiguier et al. | |
| 6,626,244 | B2 | 9/2003 | Powers | |
| 6,659,185 | B2 | 12/2003 | Dennistoun et al. | |
| 6,666,271 | B2 | 12/2003 | Deaton et al. | |
| 6,776,240 | B2 | 8/2004 | Kenison et al. | |
| 6,851,477 | B2 | 2/2005 | Hill, Jr. et al. | |
| 6,854,519 | B2 | 2/2005 | Deaton et al. | |
| 6,880,641 | B2 | 4/2005 | Dennistoun et al. | |
| 6,988,556 | B2 | 1/2006 | Vick, Jr. | |
| 6,991,040 | B2 | 1/2006 | Hill et al. | |
| 7,055,607 | B2 | 6/2006 | Jacob | |
| 7,178,599 | B2 | 2/2007 | Anderson et al. | |
| 7,195,072 | B2 | 3/2007 | McKay | |
| 7,213,653 | B2 | 5/2007 | Vick, Jr. | |
| 7,246,668 | B2 | 7/2007 | Smith | |
| 7,314,091 | B2 | 1/2008 | Wagner et al. | |
| 7,392,849 | B2 | 7/2008 | Lauderdale et al. | |
| 7,434,626 | B2 | 10/2008 | Vick, Jr. | |
| 7,487,830 | B2 * | 2/2009 | Wolters et al. | 166/242.6 |
| 7,552,774 | B2 | 6/2009 | Anderson et al. | |
| 7,624,807 | B2 | 12/2009 | Vick, Jr. | |
| 7,654,333 | B2 | 2/2010 | Smith | |
| 7,694,742 | B2 | 4/2010 | Bane et al. | |
| 7,878,252 | B2 | 2/2011 | Smith et al. | |
| 7,954,550 | B2 | 6/2011 | Anderson | |
| 2002/0060075 | A1 * | 5/2002 | Purkis et al. | 166/313 |
| 2008/0078556 | A1 * | 4/2008 | Stoesz et al. | 166/378 |
| 2008/0314599 | A1 | 12/2008 | Bane et al. | |
| 2009/0229817 | A1 * | 9/2009 | Partouche | 166/242.6 |
| 2010/0206582 | A1 | 8/2010 | Meyyappan et al. | |
| 2012/0073829 | A1 * | 3/2012 | Smith et al. | 166/375 |

FOREIGN PATENT DOCUMENTS

| | | | |
|---|---|---|---|
| GB | 2213181 | | 8/1989 |
| GB | 2355740 | A | 5/2001 |
| GB | 2419363 | | 4/2006 |
| GB | 2427214 | A | 12/2006 |
| GB | 2434166 | | 7/2007 |
| GB | 2423780 | | 9/2011 |
| WO | 99/14461 | | 3/1999 |
| WO | 03/054347 | | 7/2003 |
| WO | 2004/022906 | | 3/2004 |
| WO | 2004044379 | A2 | 5/2004 |

OTHER PUBLICATIONS

European Search and Examination Report received in application No. GB 0917053.1 dated Oct. 28, 2009.

Oceaneering International, Inc.; "Control Line Filtration Systems;" Product Information Brochure, dated Apr. 2006.

European Search and Examination Report received in application No. GB0810130.5 dated Jul. 28, 2008.

"Paintball Pressure Regulators," obtained from www.docsmachine.com/tech/regs.html, generated on Sep. 13, 2010, 3 pages.

Halliburton, "Tubing-Retrievable Subsurface Safety Valve," copyright 2008.

Weatherford, "Optimax™ Series Tubing-Retrievable Surface-Controlled Subsurface Safety Valves Models WSP . . . ", copyright 2007-2011.

Weatherford, "Optimax™ Series Tubing-Retrievable Surface-Controlled Subsurface Safety Valves Models WSSP . . . ", copyright 2007.

Weatherford, "Optimax™ Series Tubing-Retrievable Surface-Controlled Subsurface Safety Valves Models WP . . . ", copyright 2007.

Weatherford, "Optimax™ Series Tubing-Retrievable Surface-Controlled Subsurface Safety Valves Model WDB . . . ", copyright 2006-2011.

Weatherford, "Safety Valves," copyright 2005-2010.

Weatherford, "W Magazine: Optimax: 'The Missing Link,'" Sep. 2001, p. 25.

Search Reports received in corresponding European Application No. 12183602.7, dated Oct. 18, 2012.

First Office Action received in corresponding Canadian application 2,788,889, dated Apr. 25, 2013.

* cited by examiner

MULTIPLE CONTROL LINE ASSEMBLY FOR DOWNHOLE EQUIPMENT

BACKGROUND

Various downhole components use control lines for operation. For example, subsurface safety valves, such as tubing retrievable safety valves, deploy on production tubing in a producing well. Actuated by hydraulics via a control line, the safety valve can selectively seal fluid flow through the production tubing if a failure or hazardous condition occurs at the well surface. In this way, the safety valve can minimize the loss of reservoir resources or production equipment resulting from catastrophic subsurface events.

One type of safety valve is a deep-set safety valve that uses two control lines for operation. One active control line controls the opening and closing of the safety valve's closure, while the other control line is used for "balance." Due to the deep setting of the valve, this balance control line negates the effect of hydrostatic pressure from the active control line.

In FIG. 1, for example, production tubing 20 has a deep-set safety valve 40 for controlling the flow of fluid in the production tubing 20. In this example, the wellbore 10 has been lined with casing 12 with perforations 16 for communicating with the surrounding formation 18. The production tubing 20 with the safety valve 40 deploys in the wellbore 10 to a predetermined depth. Produced fluid flows into the production tubing 20 through a sliding sleeve or other type of device. Traveling up the tubing 20, the produced fluid flows up through the safety valve 40, through a surface valve 25, and into a flow line 22.

As is known, the flow of the produced fluid can be stopped at any time during production by switching the safety valve 40 from an open condition to a closed condition. To that end, a hydraulic system having a pump 30 draws hydraulic fluid from a reservoir 35 and communicates with the safety valve 40 via a first control line 32A. When actuated, the pump 30 exerts a control pressure $P_C$ through the control line 32A to the safety valve 40.

Due to vertical height of the control line 32A, a hydrostatic pressure $P_H$ also exerts on the valve 40 through the control line 32A. For this reason, a balance line 32B also extends to the valve 40 and provides fluid communication between the reservoir 35 or pressure from pump 31 and the valve 40. Because the balance line 32B has the same column of fluid as the control line 32A, the outlet of the balance line 32B connected to the valve 40 has the same hydrostatic pressure $P_H$ as the control line 32A.

As with the deep-set safety valve, there may be other reasons to run multiple control lines downhole to components. Unfortunately, the control lines have to pass uphole to a wellhead. Communicating with multiple control lines through a wellhead can present a number of challenges due to limited space, installation complexity, and sealing issues. The difficulties are exacerbated when subsea wellhead equipment is used. In general, subsea wellhead equipment has restrictions on how many penetrations can be made through it for the use of control lines, fiber optics, etc.

Typically, intelligent well completions, deep-set safety valves, and other well system require two or more control lines penetrating the wellhead and running downhole. However, current control line systems have limitations due to the restrictions on the number of wellhead penetrations that can be made as well as issues pertaining to when one of the control lines ruptures.

The subject matter of the present disclosure is directed to overcoming, or at least reducing the effects of, one or more of the problems set forth above.

SUMMARY

A multiple control line system uses concentric control lines having an outer control line disposed about at least one inner control line. For example, the concentric control lines can use an inner control line encapsulated within an outer control line. Encapsulated together, the dual control lines only require one penetration through the wellhead to extend downhole. At the wellhead, the dual control lines communicate with an operating system, which can provide hydraulics, fluid, electric power, signals, or the like for downhole components as described herein. Thus, the outer control line can convey a medium, such as fluid, power, electric signals, and optical signals, while the inner control line can convey a same or different medium.

At some point downhole, the dual control lines extending along the tubing couple to a manifold having an inlet and at least two outlets. The outer control line terminates at the inlet with a sealed fitting. The inner conduit is allowed to pass through the manifold and out one of the outlets with another sealed fitting. This inner conduit can then convey hydraulics, power, signals, or the like to one or more downhole components, such as a safety valve, a hydraulic sleeve, a sensor, a motor, a solenoid, or the like.

A separate control line couples to the other outlet of the manifold with a sealed fitting. Internally, a cross-drilled port for the outlet communicates with the annular space between the inner and outer conduits exposed in the manifold. This allows hydraulics, wiring, power, or the like from the outer control line from the surface to communicate with the separate control line extending from the manifold. From there, the separate control line can couple to the same downhole component as the inner control line or can couple to an entirely different component.

More than two control lines can be encapsulated inside one another, and more than one manifold may be used downhole to branch off other control lines. Historically, intelligent well completion tools and deep-set safety valves have required at least two control line penetrations through the wellhead for operation. Using encapsulated control lines and manifolds, the multiple control line system of the present disclosure allows one control line penetration through the wellhead to be used while giving the benefits of multiple separate control lines for operation of downhole components.

The foregoing summary is not intended to summarize each potential embodiment or every aspect of the present disclosure.

DETAILED DESCRIPTION

Figure 1:
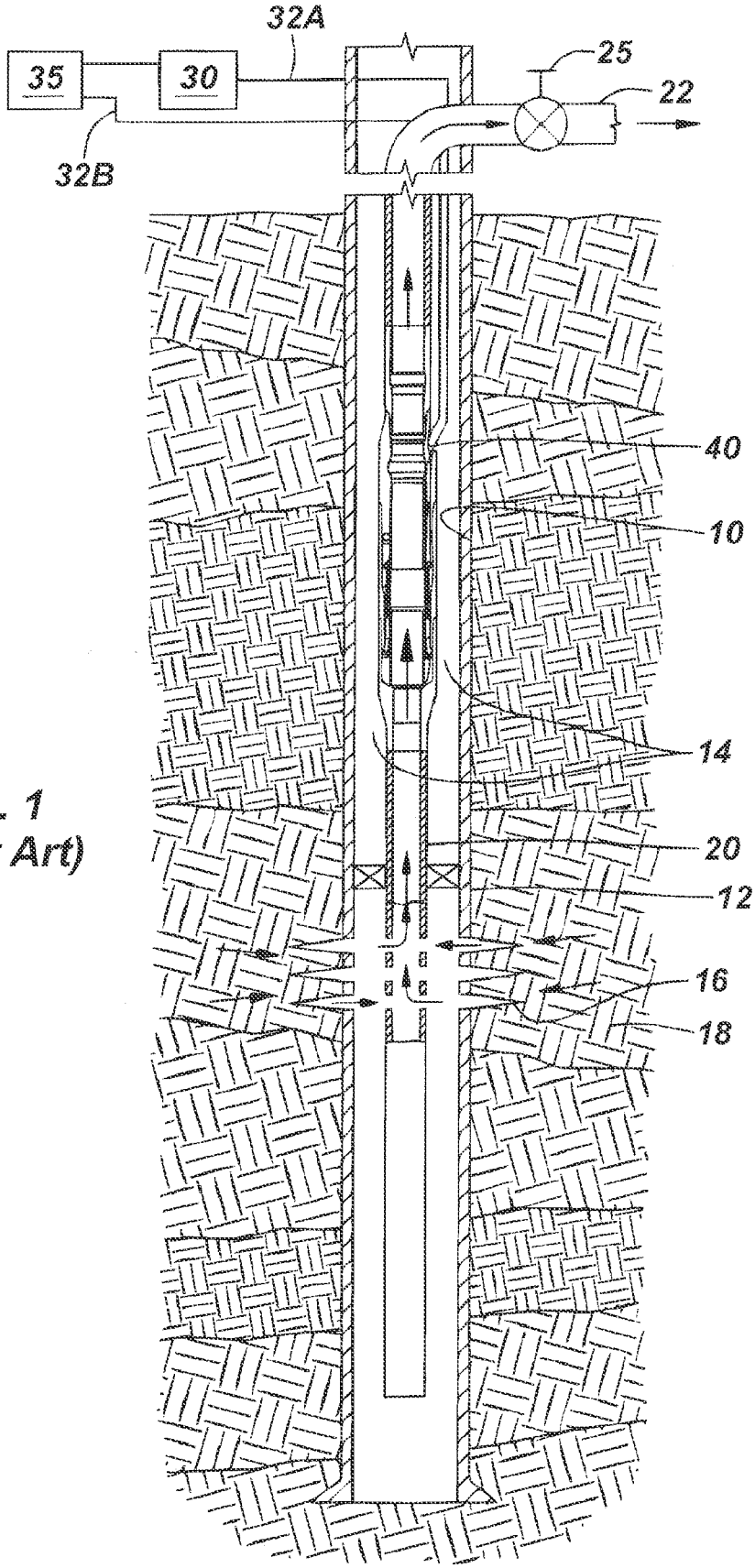
FIG. 1 (Prior Art)
FIG. 1 illustrates a wellbore having a string of production tubing, a deep-set safety valve, and a dual control line system in accordance with the prior art.
Figure 2:
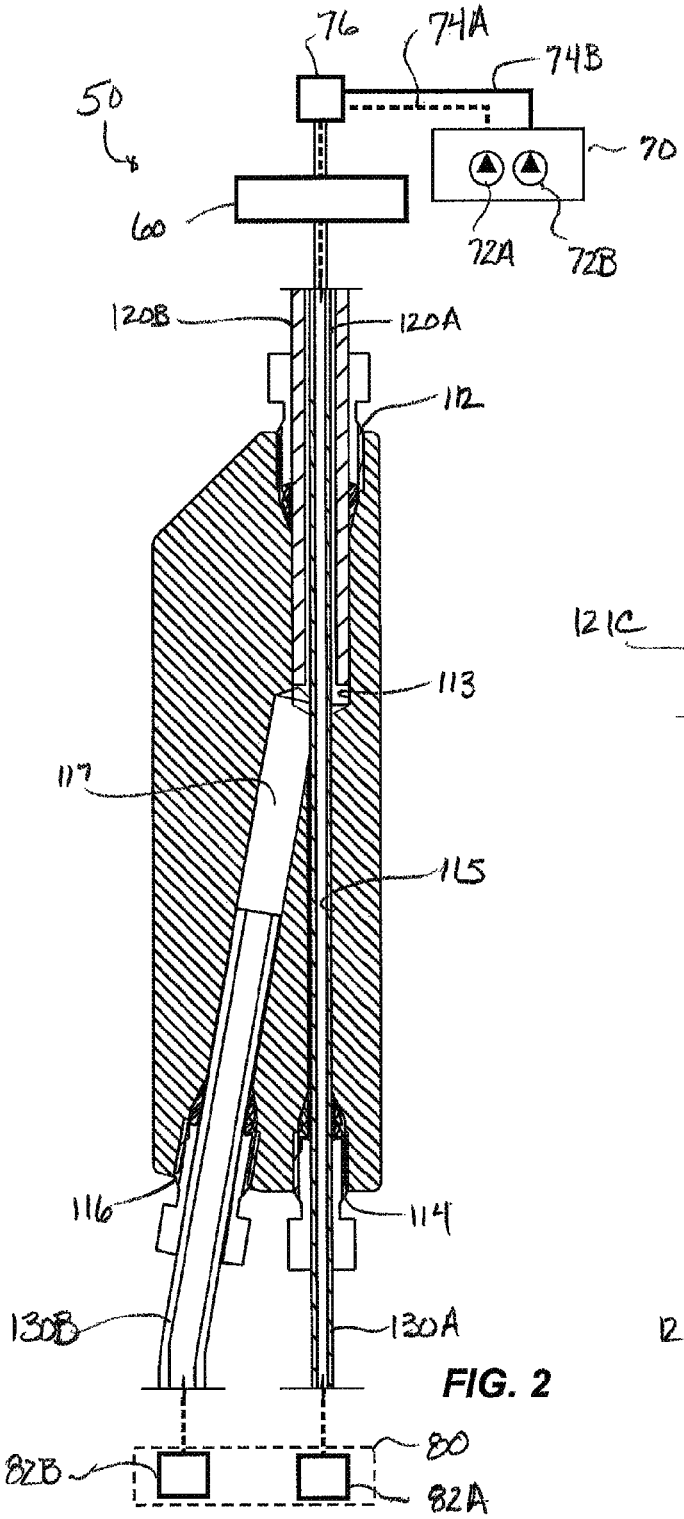
FIG. 2 shows a multiple control line system according to the present disclosure.

FIG. 2 shows a multiple control line system 50 according to certain teachings of the present disclosure. The system 50 includes a manifold 100 that disposes at some point downhole from a wellhead 60 of a wellbore. An uphole end of the manifold 100 connects to concentric control lines 120A-B. A downhole end of the manifold 100 has downhole control lines 130A-B that branch off therefrom.

The concentric control lines 120A-B pass uphole from the manifold 100 and through the wellhead 60. At the surface, an operating system 70 communicates with these control line 120A-B. In general, the operating system 70 can be a hydraulic manifold or well control panel and can have one or more pumps 72*a-b*, reservoirs 73, and other necessary components for a high-pressure hydraulic system used in wells. The operating system 70 can also include electric components for conveying power, electrical, optical, or other signals downhole. These and other possibilities can be used in the disclosed system 50. For the present disclosure, the operating system 70 is described as being hydraulic for convenience; however, the teachings of the present disclosure are applicable to other types of systems.

Extending from the manifold 100, the downhole control lines 130A-B pass to one or more downhole components 80. For example, the control lines 130A-B can connect to a deep-set safety valve as the component 80 having two actuators 82A-B. Alternatively, the downhole components 80 may include two separate safety valves with independent actuators 82A-B. Still further, the downhole components 80 can include a hydraulic device 82A and an electronic device 82B or vice a versa. For a hydraulic device, the downhole components 80 can include, but are not limited to, a tubing retrievable safety valve, a downhole deployment valve (DDV) coupled to casing, a hydraulically actuated packer, a hydraulically actuated sliding sleeve, or any other type of hydraulic tool useable downhole. For an electronic device, the downhole components 80 can include, but are not limited to, a sensor, a motor, a telemetry device, a memory unit, a solenoid, or any other electronic component useable downhole.

As noted herein, passing control lines through the components of the wellhead 60 can be complicated. Thus, use of the concentric control lines 120A-B between the operating system 70 and the manifold 100 reduces the complications associated with passing control lines through the wellhead 60. As shown in FIG. 2, the concentric control lines 120A-B include an inner control line 120A encapsulated in at least one outer control line 120B. This encapsulation of the smaller control line 120A inside the larger control line 120B means that the lines 120A-B need to penetrate the wellhead 60 once. Yet, the encapsulated control lines 120A-B still enable downhole components 80 to use multiple separate control line fluids.

The concentric control lines 120A-B are manufactured as one, and the manifold 100 splits or separates the concentric control lines 120A-B to the downhole control lines 130A-B. To assemble the manifold 100, the outer control line 120B is cut to a length that exposes enough of the inner control line 120A to feed through the manifold 100. A fitting 112 having a jam nut and ferrules crimps and seals the outer control line 120B in a port 113 of the manifold 100.

The inner control line 120A exits an opposing port 115 at the bottom of the manifold 100, and another fitting 114 having a jam nut and ferrules crimps and seals the inner control line 120A in the port 115. As shown, the inner control line 120A can pass directly through the manifold 100 uninterrupted from the uphole end to the downhole end. In this way, the inner control line 120A does not need to be severed or cut to affix to the manifold 100, although such an arrangement could be used as needed. The downhole control line 130A is therefore the same lines as the inner control line 120A.

To create the split, the manifold 100 defines a cross-drilled port 117 that intersects with the uphole port 113. In this way, the cross-drilled port 117 can communicate with the annulus between the outer control line 120B and the inner control line 120A. At the cross-drilled port 117, a fitting 116 having a jam nut and ferrules crimps and seals the other downhole control line 130B in the manifold 100.

Both control lines 120A/130A and 120B/130B can convey hydraulic fluid between the operation system 70 and downhole components 80. Alternatively, one set of control lines (i.e., 120A/130A) can convey electric wiring, fiber optics, or the like, while the surrounding control lines 120B/130B can convey hydraulics. The reverse is also possible as is the arrangement of both lines 120A/130B and 120B/130B conveying electric wiring, fiber optics, or the like rather than hydraulic fluid.

The operating system 70 can have multiple lines 74A-B extending from actuators 72A-B, which can be pumps, reservoirs, power supplies, control units, sensor units, etc. An uphole manifold 76, which can be a reverse of the disclosed manifold 100, can be used uphole of the wellhead 60 to combine the system's multiple lines 74A-B to the concentric lines 120A-B. This uphole manifold 76 can be separate from the wellhead 60 or can be incorporated into a control line hanger (not shown) disposed in the wellhead 60.

Although two concentric control lines 120A-B are shown in FIG. 2 used with a manifold 100, it will be appreciated that multiple manifolds 100 can be used along the length of concentric control lines to branch off any number of outer control lines. Thus, the teachings of the present disclosure are not restricted to only two concentrically arranged control lines.

Figure 3:
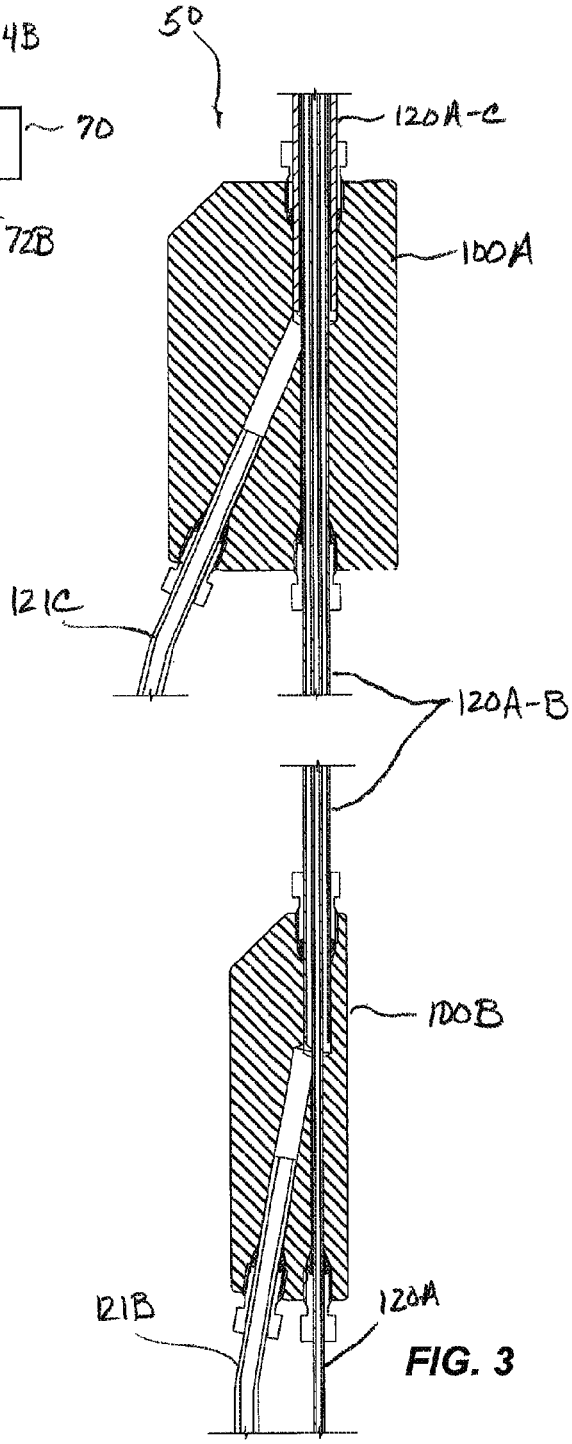
FIG. 3 shows an arrangement of multiple manifolds and encapsulated control lines for the multiple control line system.

As shown in FIG. 3, for example, the multiple control line system 50 can include two or more manifolds 100A-B and multiple concentric control lines 120A-C. In this example, the concentric control lines 120A-C include an inner control line 120A, an intermediate control line 120B, and an outer control line 120C, although more can be used. A first manifold 100A has a distal end of the outer control line 120C crimped and sealed therein so it communicates with a branching control line 121C. Meanwhile, the intermediate control line 120B along with the encapsulated inner control line 120A pass through this first manifold 100A to another manifold 100B.

At this second manifold 100B, a distal end of the intermediate control line 120B is crimped and sealed therein so it communicates with a branching control line 121B. Meanwhile, the inner control line 120A pass through this second manifold 100B to components further downhole. As will be appreciated, the branching off the various control lines 120A-C can be used to operate separate downhole components independently or to achieve any variety of useful purposes downhole.

In general, the disclosed manifold 100 can dispose at any desirable point downhole from a wellhead. For example, the manifold 100 as shown in FIG. 2 can dispose far downhole near the downhole components 80 to which the downhole control lines 130A-B connect. This enables the concentric control lines 120A-B to be run as one armored control line along the majority of tubing. This conserves space in the annulus and reduces the complication of protecting and securing the control lines on the tubing. As an alternative, the manifold 100 can be set uphole near the wellhead 60 or at any point along the tubing string. For example, the manifold 100 can be set at a point along the tubing where one line needs to branch off to one downhole component while the other line may extend further downhole to connect to another downhole component.

Figure 4A:
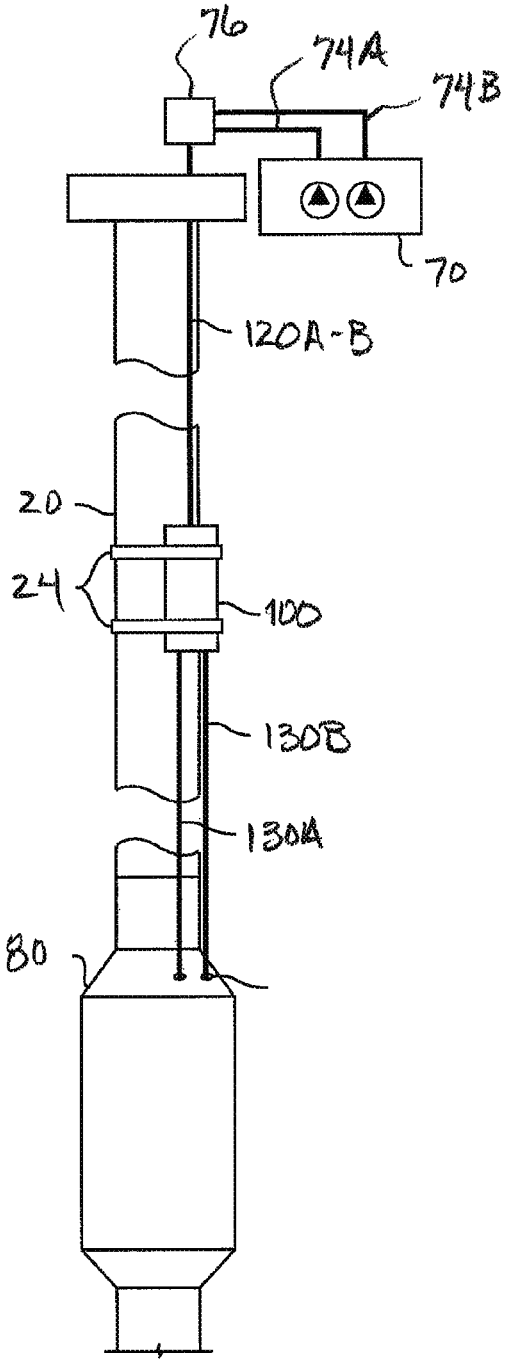
FIGS. 4A-4B illustrate how components of the multiple control line system of FIG. 2 can be connected to tubing.

Preferably, the manifold 100 plumbs to a safety valve or other downhole component and deploys through the wellhead 60 when run downhole. In one arrangement shown in FIG. 4A, for example, the manifold 100 can be attached to tubing 20 above a downhole component 80, such as a safety valve. In this embodiment, the components are attached by straps or bandings 24 known in the art that are typically used to strap control lines to tubing 20.

Figure 4B:
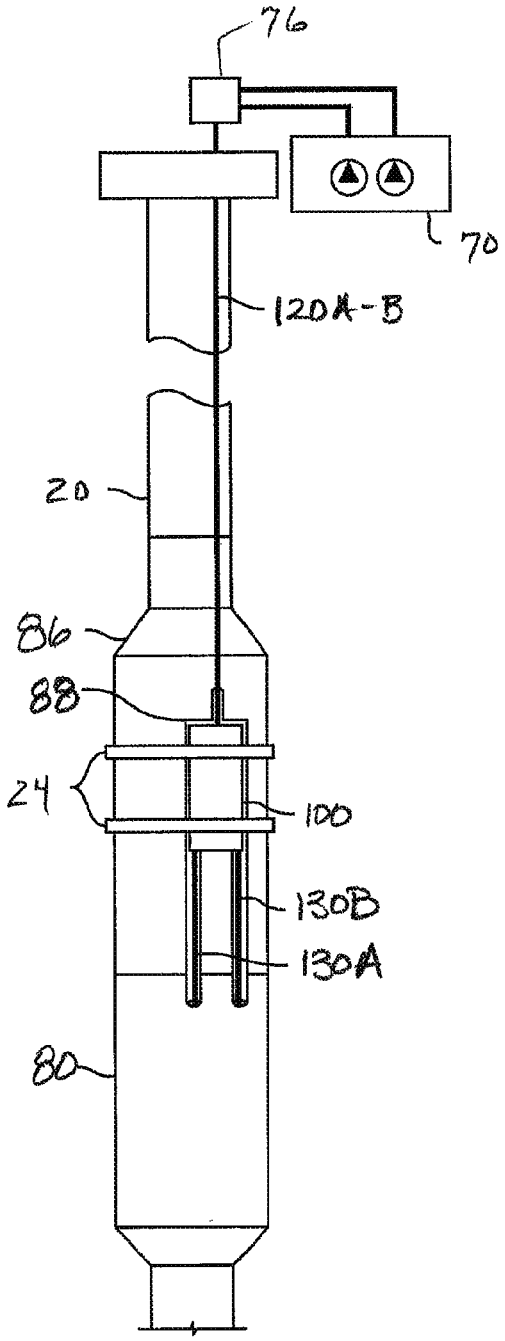

In another arrangement shown in FIG. 4B, an independent sub-assembly 86 houses the manifold 100. The sub-assembly 86 is connected between the tubing 20 and the downhole component 80, such as a safety valve. The sub-assembly 86 defines wells 88 in its outside surface to accommodate the components. Again, bandings 24 or other devices can be used to hold the components in the wells 88 of the sub-assembly 86. In addition to the arrangements shown in FIGS. 4A-4B, one skilled in the art will appreciate that other arrangements can be used to attach the manifold 100 to the tubing 20 and/or the downhole component 80.

With an understanding of the multiple control line system 50 of the present disclosure provided above, discussion now turns to example implementations of the disclosed system used with various downhole components. For example, multiple control line systems 90A-C in FIGS. 5 through 7 operate with a deep-set safety valve 150, while the multiple control line system 90D in FIG. 8 operates with a surface controlled sub-surface safety valve 170. In each of these examples, the multiple control line systems 90A-D includes a well control panel or manifold of a hydraulic system 70, which can have one or more pumps 72*a-b*, reservoirs 73, and other necessary components for a high-pressure hydraulic system used in wells.

As described previously, the deep-set safety valve 150 of FIGS. 5 through 7 installs on production tubing (not shown) disposed in a wellbore, and the safety valve 150 controls the uphole flow of production fluid through the production tubing. In use, the safety valve 150 closes flow through the tubing in the event of a sudden and unexpected pressure loss or drop in the produced fluid, which coincides with a corresponding increase in flow rate within the production tubing. Such a condition could be due to the loss of flow control (i.e., a blowout) of the production fluid. During such a condition, the safety valve 150 is closed by relieving the hydraulic control pressure which actuates the safety valve to the closed position and shuts off the uphole flow of production fluid through the tubing. When control is regained, the safety valve 150 can be remotely reopened to reestablish the flow of production fluid.

Figure 5:
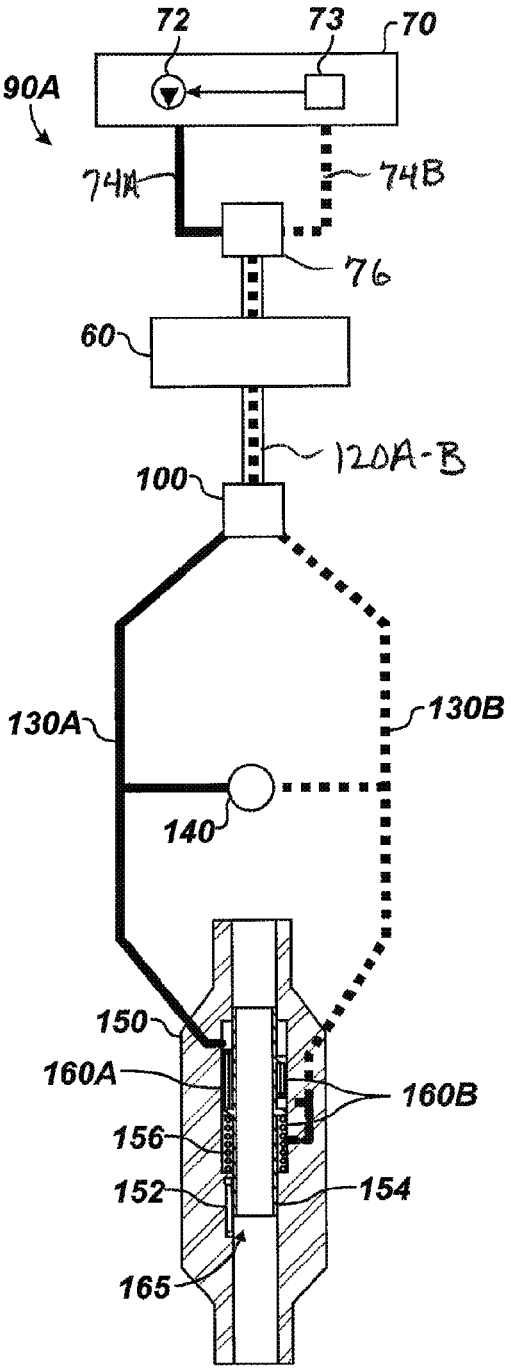
FIGS. 5, 6, and 7 illustrate configurations of a multiple control line system in accordance with the present disclosure for a deep-set safety valve.

In the dual control line system 90A of FIG. 5, for example, two control lines 120A-B extend from the wellhead 60 and down the well to the manifold 100 and the deep-set safety valve 150. One of the control lines 120A communicates with the pump 72 of the hydraulic system 70, while the other control line 120B communicates with the reservoir 73 of the hydraulic system 70 in a manner similar to that described in U.S. Pat. No. 7,392,849, which has been incorporated herein by reference in it its entirety.

Figure 6:
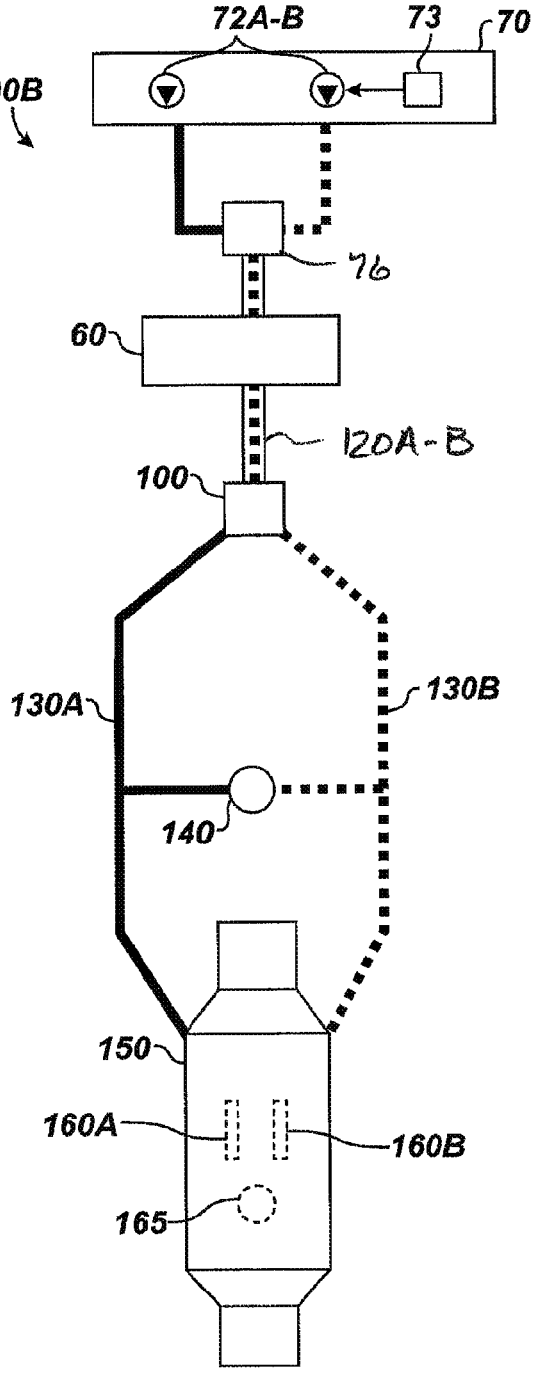

In the control line system 90B of FIG. 6, two control lines 120A-B extend from the wellhead 60 and down the well to the manifold 100 and the deep-set safety valve 150. In this configuration, however, both control lines 120A-B communicate with the one or more pumps 72*a-b* of the hydraulic system 70 and are separately operable. Using this configuration, operators can open and close the deep-set safety valve 150 in both directions with hydraulic fluid from the control lines 120A-B being separately operated with the hydraulic system 70. Either way, one of the control lines (e.g., 120B) in FIGS. 5-6 acts as a balance line. This balance line 120B can offset the hydrostatic pressure in the primary control line 120A, allowing the safety valve 150 to be set at greater depths.

As another alternative, the configuration of the control line system 90C in FIG. 7 has the balance control line 120B terminated or capped off below the wellhead 60. Thus, only the primary control line 120A runs to the surface and the hydraulic system 70, while the balance control line 120B for offsetting the hydrostatic pressure terminates below the wellhead 60 with a cap 125.

In each of these implementations, one or more connection lines 74A-B couple from the hydraulic system 70. In FIGS. 5-6, the dual lines 74A-B can connect to a reverse manifold 76 that combines the lines 74A-B into the concentric control lines 120A-B. In FIG. 7, one line 74A may only be needed. Passing through the wellhead 60 as one penetration, the concentric control lines 120A-B extend down the tubing to the manifold 100, which may be situated close to the deep-set safety valve 150. Here, the outer control line 120A/130A branches off from the inner control line 120B/130B.

Figure 7:
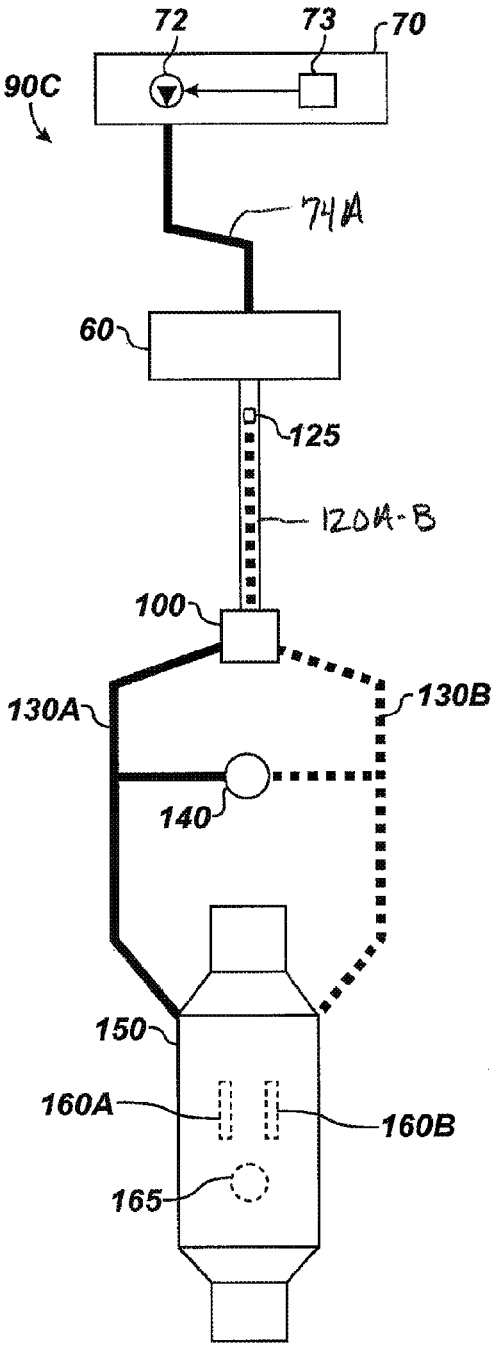

For its part, the safety valve 150 in FIGS. 5-7 can include any of the deep-set valves known and used in the art. In one implementation, the deep-set safety valve 50 can have features such as disclosed in incorporated U.S. Pat. No. 7,392,849. In general, the deep-set safety valve 150 uses hydraulic pressures from the two downhole control lines 130A-B to actuate a closure 165 of the valve 150 so the valve 150 can be set at greater depths downhole.

As best shown in FIG. 5, for example, the primary or active control line 130A can operate a primary actuator 160A in the valve 150, while the second or balance control line 130B can operate a second actuator 160B. As shown, the closure 165 can include a flapper 152, a flow tube 154, and a spring 156. The primary actuator 160A can include a rod piston assembly known in the art for moving the flow tube 154. The balance actuator 160B can also include a rod piston assembly known in the art for moving the flow tube 154. These and other actuators 160A-B and closures 165 can be used in the safety valve 150 for the disclosed control systems 90A-C.

Either way, with the primary control line 130A charged with hydraulic pressure, the primary actuator 160A opens the closure 165. For example, the piston of the actuator 160A moves the flow tube 154 down, which opens the flapper 152 of the safety valve 150. For its part, the hydraulic pressure from the balance control line 130B offsets the hydrostatic pressure in the primary control line 130A by acting against the balance actuator 160B. For example, the balance actuator 160B having the balance piston assembly acts upward on the flow tube 154 and offsets the hydrostatic pressure from the primary control line 130A. Therefore, this offsetting negates effects of the hydrostatic pressure in the primary control line 130A and enables the valve 50 to operate at greater setting depths.

If the balance control line 130B loses integrity and insufficient annular pressure is present to offset the primary control line's hydrostatic pressure, then the valve 150 can fail in the open position, which is unacceptable. To overcome unacceptable failure, the control system 90A-C can include a fail-safe device or regulator 140 disposed at some point down the well. The regulator 140 interconnects the two control lines 130A-B to one another and acts as a one-way valve between the two lines 130A-B in a manner disclosed in co-pending application Ser. No. 12/890,056, filed 24 Sep. 2010, which is incorporated herein by reference in its entirety.

Figure 8:
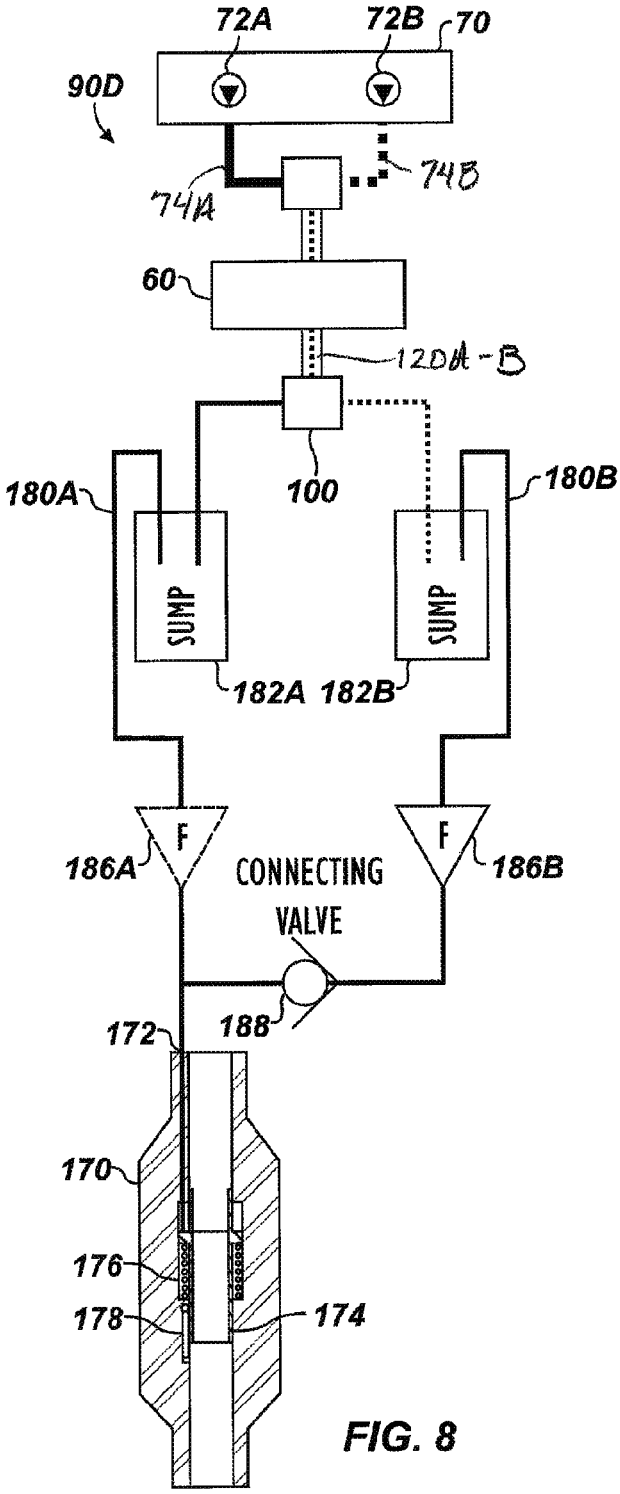
FIG. 8 illustrates one configuration of a multiple control line system for a surface controlled sub-surface safety valve according to certain teachings of the present disclosure.

FIG. 8 illustrates another control line system 90D for a typical surface controlled sub-surface safety valve 170. Much of the system 90D is similar to that described previously. Again, the system 90D has the operating system 70 coupled by connection lines 74A-B to a reverse manifold 76, and concentric control lines 120A-B run from the wellhead 60 to a downhole manifold 100.

Branching from the manifold, the system 90D includes first and second control lines 180A-B interconnected to one another by a one-way connecting valve 188 and connected to a single control port 172 on the safety valve 170. With the two control lines 180A-B run from the surface to the safety valve 170, one of the control lines 180B can power the safety valve 170 open while the second control line 180A can be used to close the valve 170.

For example, the control line 180B can be the main line, while the hydraulic system 70 maintains the other control line 180A closed at the wellhead to prevent exhausting of control fluid through it. The hydraulic system 70 at the surface applies hydraulic pressure to the control port 172 via control fluid in the control line 180B. The hydraulic pressure moves the internal sleeve 174 against the spring force 176. When sufficiently moved, the internal sleeve 174 opens the flapper 178 that normally blocks the internal bore 171 of the safety valve 170.

To close the safety valve 170, the hydraulic system 70 can exhaust the second control line 180A to a fluid reservoir (not shown), allowing the release of hydraulic pressure of the control fluid. The connecting valve 188 prevents control fluid from migrating back up through the main control line 180B. The release allows the spring force 176 to move the internal sleeve 174 and permits the flapper 178 to close the bore 171.

Likewise, the operation system 70 can communicate control fluid to the safety valve 170 via the second control line 180A to open the safety valve 170 in the event the first control line 180B is blocked or damaged. The one-way connecting valve 188 prevents the control fluid in the control line 180A from entering into the other control line 180B.

Moreover, the control line system 90D can aid in keeping the control fluid substantially clean of debris and can reduce the potential for blockage. For example, the control lines 180A-B can have sumps 182A-B to collect debris and can have in-line filters 186A-B to filter debris from the control fluid. During use, control fluid and associated debris is allowed to migrate through the system 90D so that the potential for blockage can be reduced. In addition, operators can cycle the safety valve 170 open and closed by applying control fluid with the main control line 180B and exhausting the control fluid with the other control line 180A. These and other techniques can be used, include those disclosed in U.S. Pat. Publication No. 2009/0050333, which is incorporated herein by reference in its entirety.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A multiple control line system for communicating with an output uphole of a wellhead and with first and second inputs downhole of the wellhead, the system comprising:

a multiple control line having an outer control line disposed about an inner control line, the outer control line having a proximal end in communication with the output, the inner control line having a proximal end capped off inside the outer control line and having a distal end in communication with the second input; and a manifold deploying downhole of the wellhead, the manifold connected to a distal end of the outer control line and passing the inner control line, communicating with the second input, through the manifold, the manifold connecting a separate control line, communicating with the first input, in fluid communication with the distal end of the outer control line.

2. The system of claim 1, wherein the manifold comprises:

an inlet disposed on the manifold and sealing to the distal end of the outer control line with the inner control line disposed therein;

a first outlet disposed on the manifold and sealing to the separate control line, the first outlet communicating the outer control line with the separate control line; and a second outlet disposed on the first manifold and sealing to the inner control line.

3. The system of claim 2, wherein a fastener sealably affixes the distal end of the outer control line to the inlet.

4. The system of claim 2, wherein a first fastener sealably affixes a distal end of the separate control line to the first outlet.

5. The system of claim 4, wherein a second fastener sealably affixes the inner control line to the second outlet.

6. The system of claim 1, wherein the outer control line conveys a fluid medium.

7. The system of claim 6, wherein the inner control line contains a different medium than the outer control line.

8. The system of claim 1, further comprising at least one downhole component in communication with the separate control line and the inner control line.

9. The system of claim 8, wherein the inner control line offsets hydrostatic pressure at the at least one downhole component.

10. The system of claim 8, wherein the at least one downhole component comprises a deep-set safety valve in communication with the separate control line and the inner control line.

11. The system of claim 10, wherein the first input comprises a first actuator operable to open a closure of the deep-set safety valve; and wherein the second input comprises a second actuator operable to act against the first actuator.

12. The system of claim 1, further comprising an operating system disposed uphole of the wellhead and having the output in communication with the outer control line.

13. The system of claim 12, wherein the operating system comprises a hydraulic pump for the output.

14. The system of claim 12, further comprising at least one downhole component in communication with the separate control line and the inner control line.

15. The system of claim 14, wherein the at least one downhole component comprises a deep-set safety valve in communication with the separate control line and the inner control line.

16. The system of claim 1, wherein the proximal end of the inner control line terminates below the wellhead and comprises a cap capping off the proximal end.

17. The system of claim 1, wherein the outer control line is charged with first hydraulic pressure; and wherein the inner control line is charged with second hydraulic pressure configured to offset hydrostatic pressure in the outer control line.

18. The system of claim 1, further comprising a one-way regulator connecting fluid communication from the separate control line to the inner control line.

* * * * *